US005779041A

United States Patent [19]

Nielsen

[11] Patent Number: 5,779,041

[45] Date of Patent: Jul. 14, 1998

[54] GAME BOX PROTECTOR

[76] Inventor: Dianna Nielsen, 514 A Hoala, Kihei, Hi. 96753

[21] Appl. No.: 823,892

[22] Filed: Mar. 17, 1997

[51] Int. Cl.[6] ..... B65D 81/36

[52] U.S. Cl. ..... 206/315.1; 206/579; 229/23 A; 273/148 A

[58] Field of Search ..... 206/315.1, 579; 229/23 A, 23 R; 220/464, 468; 273/148 A, 148 R, 285–287, 309

[56] References Cited

U.S. PATENT DOCUMENTS

| | | | |
|---|---|---|---|
| 2,254,154 | 8/1941 | Linney | 206/315.1 |
| 4,436,307 | 3/1984 | Caldwell | 206/315.1 |
| 4,666,042 | 5/1987 | Dlott et al. | 206/315.1 |
| 5,054,783 | 10/1991 | Hull et al. | 273/148 A |
| 5,522,508 | 6/1996 | Pesola | 206/315.1 |
| 5,586,763 | 12/1996 | De Bono et al. | 273/285 |

*Primary Examiner*—Paul T. Sewell
*Assistant Examiner*—Luan K. Bui
*Attorney, Agent, or Firm*—Paul White

[57] ABSTRACT

A game box protector (210) which has a housing (212) having a housing top (212A) which has at least one housing top insert (212AA) extending in a downwardly direction functioning as a locking means. The housing (212) further has a housing middle (212B) having a housing middle front (212BAA) securely fastened to a housing middle back (212BBA) at an outer left side edge by a housing middle left side (212BLA). The housing middle front (212BAA) is securely fastened to The housing middle back (212BBA) at an outer right side edge by a housing middle right side (212BRA). A housing middle plate (212BC) is securely fastened an outer perimeter to an inner side edge of the housing middle back (212BBA) and the housing middle left side (212BLA) and the housing middle back (212BBA) and the housing middle right side (212BRA). A game box top (14A) is insertable between the outer edges and inner of the housing middle back (212BBA) and the housing middle left side (212BLA) and the housing middle back (212BBA) and the housing middle right side (212BRA) resting upon the housing middle plate (212BC). A housing middle plate (212BC) is the housing top (212A) is removably insertable into the housing middle (212B). The housing (212) further has a housing bottom (212C) hingeably attached to an upper edge of the housing middle back (212BBA) by a housing bottom top hinge (212CAA). The housing bottom (212C) has a housing bottom top panel (212CA) attached at a perpendicular angle to a housing bottom bottom panel (212CB). The housing bottom bottom panel (212CB) further has at least one housing bottom bottom panel insert (212CBB) extending upwardly which functions to lock the housing bottom bottom panel (212CB) to the housing middle (212B). A game box bottom (14B) is insertable from a bottom direction into the protected game box top (14A) contained within the housing middle (212B).

5 Claims, 4 Drawing Sheets

GAME BOX PROTECTOR

BACKGROUND OF THE INVENTION

1. Field of the Invention

The present invention relates to boxes. More particularly, the present invention relates to a game box protector which has a housing for games top box which functions to protect a game top box therein and a hinged bottom which functions to contain game's bottom and accessories therein.

2. Description of the Prior Art

Boxes are well known in the art. However, boxes with a housing for box tops and a hinged bottom are unique. Furthermore, boxes with a hinged bottom to uniquely provide original function of opening and closing the games. The major purpose of the present invention is to protect game boxes from being destroyed during use and storage. Most game boxes are constructed from paper composites such as cardboard having a film laminated thereon. During storage, the cardboard absorbs moisture, ozone and becomes frail. Hence, there exists a need for a game box protector to house an ordinary game box therein.

Numerous innovations for boxes have been provided in the prior art that are described as follows. Even though these innovations may be suitable for the specific individual purposes to which they address, they differ from the present invention as hereinafter contrasted.

U.S. Pat. No. 5,217,774, titled, Game Box Protector and Repair Device, was issued to Thomas M. Finrow on Jun. 8, 1993. The Game Box Protector and Repair Device is used to reinforce the corners of paper and plastic boxes such as those used by toy manufacturers. It has two parts, a flexible sheet of filament impregnated tape having an adhesive coating on its bottom surface and a flexible sheet of backing release paper that lightly adheres to the bottom surface of the sheet of filament impregnated tape. The filament impregnated tape has a substantially rectangular main body portion having a left finger tab and a right finger tab that are laterally spaced from each other a predetermined distance and which extend from the top edge of the main body portion. When applied to the game box, the main body portion adheres to the outside surface of the walls forming the comer and the finger tabs are folded over the top edge of the side walls so that they adhere to the inside surface of the walls forming the corner.

The patented invention is a reinforcement that is applied to deteriorated game boxes. The present invention is an entirely new housing for game top box having a hingeably mounted bottom eliminating deteriorating initially or altogether.

U.S. Pat. No. 5,294,044, titled Fiberboard Box With Reinforced Corners, was issued to Danny W. Clark on May 15, 1994. The Fiberboard Box with reinforced Corners 11 is formed from a flat formed blank which is folded to take a box shape with reinforced corners. The folded Fiberboard Box with Reinforced Comers is glued or taped to hold its shape.

The patented invention is constructed from fiberboard resulting in a box that has triangular shaped comer reinforcements in the box corners. It is not designed as a storage device for games. The present invention is a box for containing games box top and bottom, and accessories therein and protecting them from the original game box ever disintegrating such that it no longer can contain the original board game and accessories. The present invention has a housing which comprises a mounted top a hingeable, bottom and a result of the normal function of opening and closing the game.

U.S. Pat. No. 3,608,903, titled Game Box Enclosing Inflated Balloons, was issued to Julius Cooper on Sep. 28, 1971. The Game Box Enclosing Inflated Balloons is a toy game apparatus and playing pieces including a box with open bottom and closed top. The top serves as the playing surface having precut nail receiving perforations. A balloon is placed inside the box and nails are driven through the top by the players the first one to break the balloon wins.

The patented invention is a game that is played using nails and inflated balloons whereas the present invention is a box for containing existing games and protecting them from ever disintegrating such that it no longer can contain the original game box and accessories.

U.S. Pat. No. 4,979,619, titled Protective Case for Collectable Sports Cards, was issued to Alan C Hager on Dec. 25, 1990. A transparent plastic case provides for protection and long term storage of sports cards. The case is comprised of front and rear panels of matching elongated rectangular perimeter adapted to be cohesively sealed to enclose a sports card and a documentation card. The dimensions of the case relative to the sports card is such that the sports card within the sealed case is free to move slightly. The panels are further configured to facilitate stacking of a number of the cases.

The patented invention is designed to contain sports cards. By design, since the sports cards are small in size, the resultant case is much smaller than what is required to contain a game. The present invention is a protective box into which an original game box top is inserted and thereafter protected from abuse and deterioration. In addition, the present invention has unique features such as a housing which comprises a hingeably mounted top and bottom to contain bottom box so original motion of opening and closing remains the same.

U.S. Pat. No. 5,385,231, titled, Package for Compact Disk, was issued to Robert C.

Nowotny on Jan. 31, 1995. The case for compact disks has a hinged lid and base held in the closed position by both a breakable tab and a dimple. Initially the tab is broken by the user, after which access is easier due to the relative low forces the dimple exerts on the lid to hold it closed.

The patented invention is designed to contain compact disks. The present invention is a plastic protective box into which an original game box is inserted and thereafter protected from abuse and deterioration. Further more the present invention is intended to be purchased after the game is owned. The present invention has a housing for top box which comprises a hingeably mounted top and bottom to contain games bottom box and function as originally intended by game manufacturer.

U.S. Pat. No. 5,245,815, titled Pre-Wrapped Gift Package was issued to Tommy R. Savage on Sep. 21, 1993. The invention provides a method of forming a pre-wrapped gift package which appears to be hand-wrapped. The method includes forming a sheet of box construction material with decorative paper attached to the material.

The patented invention is a light-weight box material on which a wrapping paper pattern has been applied or printed. It is folded like wrapping paper and fastened in a similar fashion. The present invention is a preformed ridged box with a housing for top box and a hingeably mounted top and bottom designed to fit the size of a games original bottom box to be protected.

Numerous innovations for boxes have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a game box protector which has a housing for game top box compartment which functions to contain a game box therein and a hinged bottom to contain bottom box and accessories therein.

The types of problems encountered in the prior art are game boxes deteriorate during time.

In the prior art, unsuccessful attempts to solve this problem were attempted namely: secondary boxes and film wrapping. However, the problem was solved by the present invention because the housing is constructed from a durable on degradable moisture resistant material.

Innovations within the prior art are rapidly being exploited in the field of boxes.

The present invention went contrary to the teaching of the art of placing the game top box in a stronger secondary box for storage and hingeable bottom to uniquely encase game and its entirety.

The present invention solved a long felt need for a game box protector so that unique and interesting games such as MONOPOLY (™) can be preserved for generations even when the original manufacturer ceases to make the game.

Accordingly, it is an object of the present invention to provide a game box protector.

The present invention produced unexpected results namely: the game protector became the primary box due to its ability to house the game box in a safe environment for future generations to utilize which does not alter the original function of opening and closing the game.

In keeping with these objects, and with others which will become apparent hereinafter, one feature of the present invention resides, briefly stated, in the housing bottom is movably attached to the housing back by a housing bottom hinge.

When the housing bottom is designed in accordance with the present invention, it is movably attached to the housing back by a housing bottom hinge.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

14—game box (14)
14A—game box top (14A)
14B—game box bottom (14B)
210—game box protector (210)
212—housing (212)
212A—housing top (212A)
212AA—housing top insert (212AA)
212AB—housing top plateau (212AB)
212B—housing middle (212B)
212BAA—housing middle front (212BAA)
212BAC—housing middle stopper (212BAC)
212BBA—housing middle back (212BBA)
212BRA—housing middle right side (212BRA)
212BLA—housing middle left side (212BLA)
212BC—housing middle plate (212BC)
212C—housing bottom (212C)
212CAA—housing bottom top hinge (212CAA)
212CAB—housing bottom bottom hinge (212CAB)
212CA—housing bottom top panel (212CA)
212CB—housing bottom bottom panel (212CB)
212CBA—housing bottom bottom panel valley (212CBA)
212CBB—housing bottom bottom panel insert (212CBB)

DESCRIPTION OF THE PREFERRED EMBODIMENT

Figure 1:
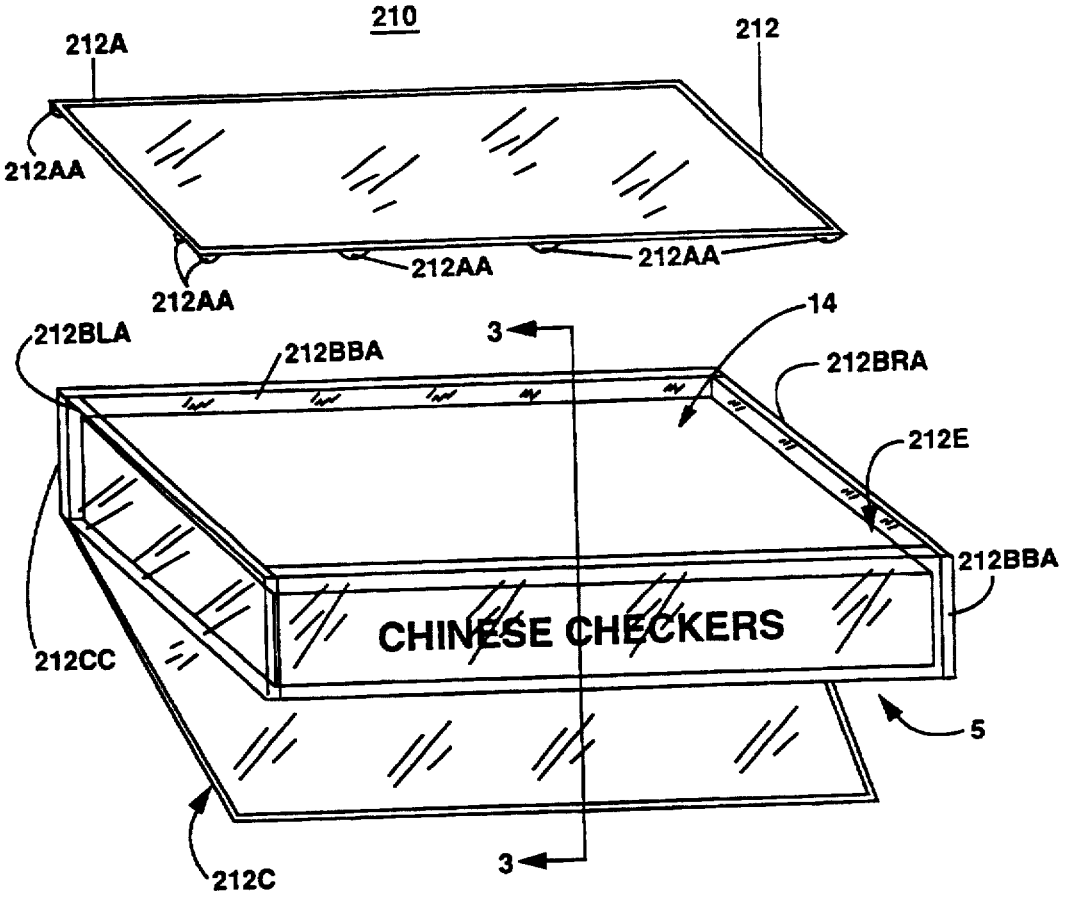
FIG. 1 is a front left perspective view of a game box protector with a housing top and a housing bottom in open positions.
Figure 2:
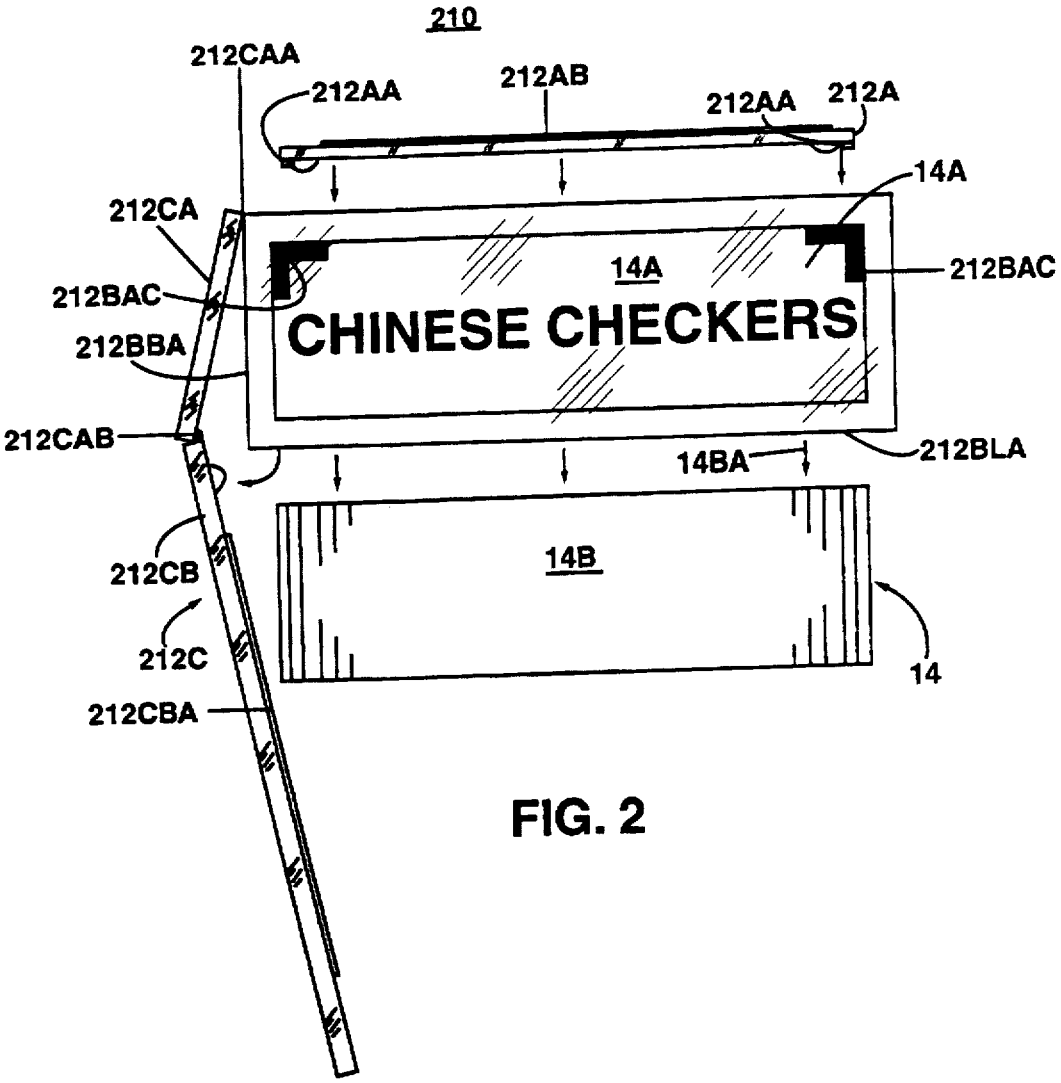
FIG. 2 is a cross-sectional side view of a game box protector.
Figure 2A:
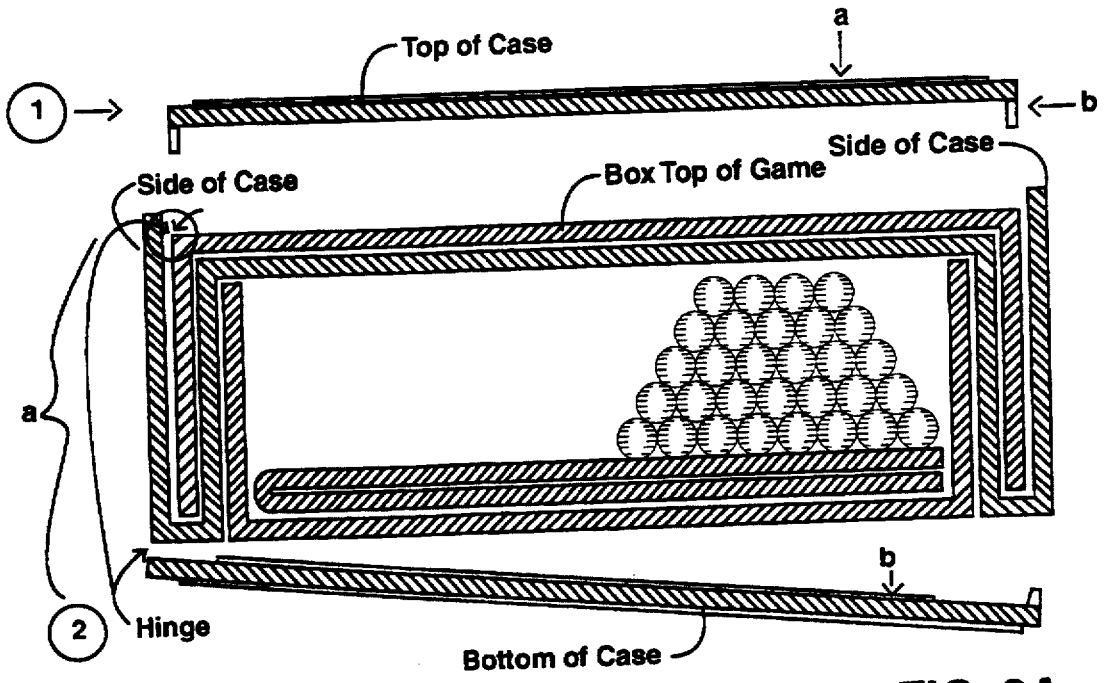
Figure 3:
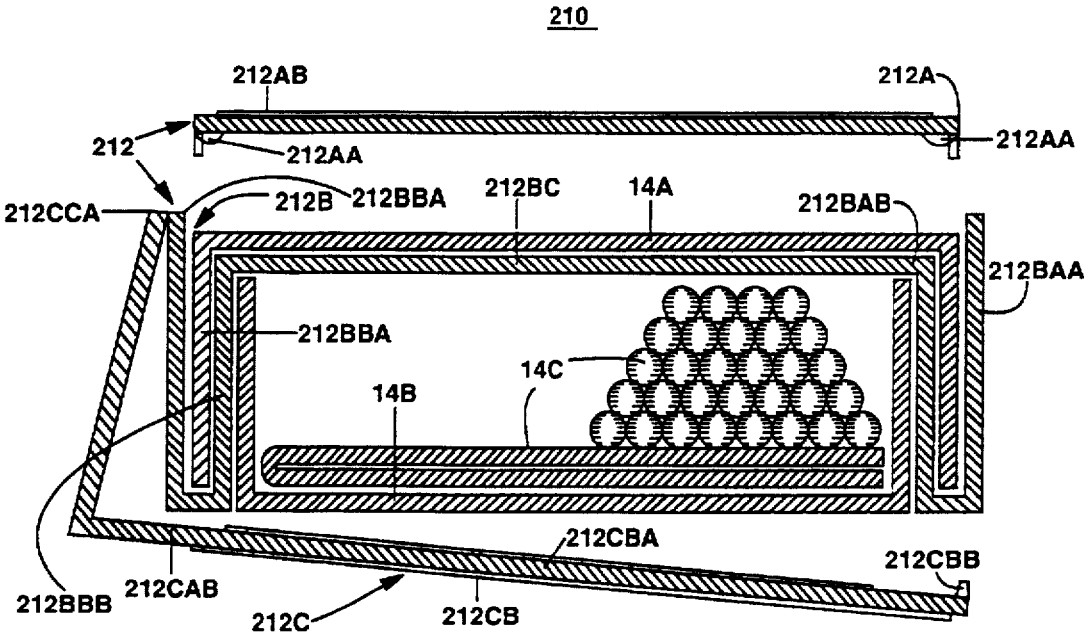
FIG. 3 is a side view of a game box protector with a housing top and a housing bottom in open positions having a game box bottom inserted therein.

Referring to FIG. 1 which is a front left perspective view of a game box protector (210) with a housing top (212A) and a housing bottom (212C) in open positions. Now, referring to FIG. 2 which is a cross-sectional side view of a game box protector (210). Refering to FIG. 3 which is a side view of a game box protector (210)with a housing top (212A) and a housing bottom (212C) in open positions having a game box bottom (14B) inserted therein. The game box protector (210) comprises a housing (212) which comprises a housing top (212A) which comprises at least one housing top insert (212AA) extending in a downwardly direction and a housing top plateau (212AB) extending in an upwardly direction. The at least one housing top insert (212AA) engages the top of the housing bottom (212C). The housing top plateau (212AB) functions as a stacking means for a plurality of game box protectors (210). The at least one housing top insert (212AA) function as a locking means.

The game box protector (210) further comprises a housing middle (212B) which comprises a housing middle front (212BAA) securely fastened to a housing middle back (212BBA) at an outer left side edge by a housing middle left side (212BLA). The housing middle front (212BAA) is securely fastened to the housing middle back (212BBA) at an outer right side edge by a housing middle right side (212BRA). A housing middle plate (212BC) is securely fastened an outer perimeter to an inner side edge of the housing middle back (212BBA) and the housing middle left side (212BLA) and the housing middle back (212BBA) and the housing middle right side (212BRA). A game box top (14A) is insertable between the outer edges and inner of the housing middle back (212BBA) and the housing middle left side (212BLA) and the housing middle back (212BBA) and the housing middle right side (212BRA) resting upon the housing middle plate (212BC). A housing middle stopper (212BAC) prevents the game box bottom (14B) from being suctioned into the game box top (14A) and unretrievable. Therefore, the housing bottom bottom panel valley (212CBA) picks up the slack from the housing middle stopper (212BAC). A housing middle plate (212BC) is the housing top (212A) is removably insertable into the housing middle (212B).

The game box protector (210) comprises a housing bottom (212C) is hingeably attached to an upper edge of the housing middle back (212BBA) by a housing bottom top hinge (212CAA). The housing bottom (212C) comprises a housing bottom top panel (212CA) perpendicularly attached to a housing bottom bottom panel (212CB). Optionally, the housing bottom (212C) may comprise a housing bottom top panel (212CA) hingeably attached to a housing bottom bottom panel (212CB) by a housing bottom bottom hinge (212CAB). The housing bottom top panel (212CA) further comprises a housing bottom bottom panel valley (212CBA) into which housing top plateau (212AB) of an adjacent game box protector (210) is insertable. The housing bottom bottom panel (212CB) further comprises at least one housing bottom bottom panel insert (212CBB) extending upwardly which functions to lock the housing bottom bottom panel (212CB) to the housing middle (212B). A game box bottom (14B) is insertable from a bottom direction into the protected game box top (14A) contained within the housing middle (212B).

The housing (212) is manufactured from a material selected from a group consisting of plastic, plastic composite, metal, metal alloy, rubber, rubber composite, wood, wood composite, paper composite, fiberglass, epoxy, and carbon-graphite.

It will be understood that each of the elements described above, or two or more together, may also find a useful application in other types of constructions differing from the type described above.

While the invention has been illustrated and described as embodied in a game box protector, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A game box protector (210) comprising:

A) a housing (212) which comprises:

i) a housing middle (212B) and a housing top (212A) which comprises at least one housing top insert (212AA) extending in a downwardly direction which functions to lock the housing top to the housing middle, ii) the housing middle which comprises a housing middle front (212BAA) securely fastened to a housing middle back (212BBA) at an outer left side edge by a housing middle left side (212BLA), the housing middle front (212BAA) is securely fastened to the housing middle back (212BBA) at an outer right side edge by a housing middle right side (212BRA), a housing middle plate (212BC) is securely fastened an outer perimeter to an inner side edge of the housing middle back (212BBA) and the housing middle left side (212BLA) and the housing middle back (212BBA) and the housing middle right side (212BRA), a game box top (14A) is insertable between the outer edges and inner of the housing middle back (212BBA) and the housing middle left side (212BLA) and the housing middle back (212BBA) and the housing middle right side (212BRA) resting upon the housing middle plate (212BC), is the housing top (212A) is removably insertable into the housing middle (212B), iii) a housing bottom (212C) is hingeably attached to an upper edge of the housing middle back (212BBA) by a housing bottom top hinge (212CAA), the housing bottom (212C) comprises a housing bottom top panel (212CA) attached at a perpendicular angle to a housing bottom bottom panel (212CB), the housing bottom bottom panel (212CB) further comprises at least one housing bottom bottom panel insert (212CBB) extending upwardly which functions to lock the housing bottom bottom panel (212CB) to the housing middle (212B), a game box bottom (14B) is insertable from a bottom direction into the game box top (14A) contained within the housing middle (212B).

2. The game box protector (210) as described in claim 1, wherein the housing top (212A) further comprises a housing top plateau (212AB) extending in an upwardly direction, the housing top plateau (212AB) functions as a stacking means for a plurality of game box protectors (210).

3. The game box protector (210) as described in claim 1, wherein the housing bottom top panel (212CA) further comprises a housing bottom bottom panel valley (212CBA) into which the housing top plateau (212AB) of an adjacent game box protector (210) is insertable.

4. The game box protector (210) as described in claim 1, wherein the housing bottom top panel (212CA) is attached at a perpendicular angle to the housing bottom bottom panel (212CB) by a housing bottom bottom hinge (212CAB).

5. The game box protector (210) as described in claim 1, wherein the housing (212) is manufactured from a material selected from a group consisting of plastic, plastic composite, metal, metal alloy, rubber, rubber composite, wood, wood composite, paper composite, fiberglass, epoxy, and carbon-graphite.

* * * * *